US005540598A

United States Patent [19]

Davis

[11] Patent Number: 5,540,598

[45] Date of Patent: Jul. 30, 1996

[54] PIN SPACER FOR AN ELECTRICAL CONNECTOR

[75] Inventor: Wayne S. Davis, Harrisburg, Pa.

[73] Assignee: The Whitaker Corporation, Wilmington, Del.

[21] Appl. No.: 260,937

[22] Filed: Jun. 16, 1994

[51] Int. Cl.[6] ..... H01R 23/70

[52] U.S. Cl. ..... 439/79

[58] Field of Search ..... 439/79, 381

[56] References Cited

U.S. PATENT DOCUMENTS

| | | | |
|---|---|---|---|
| 3,512,116 | 5/1970 | Miwa et al. | 339/12 |
| 4,469,387 | 9/1984 | McHugh | 439/140 |
| 4,583,807 | 4/1986 | Kaufman et al. | 439/83 |
| 4,655,516 | 4/1987 | Shaffer et al. | 339/17 CF |
| 4,826,442 | 5/1989 | Douty et al. | 439/92 |
| 4,842,528 | 6/1989 | Frantz | 439/80 |
| 4,986,772 | 1/1991 | Fukutani | 439/79 |
| 4,992,054 | 2/1991 | Cassan | 439/76 |
| 5,004,430 | 4/1991 | DelGuidice et al. | 439/350 |
| 5,055,069 | 10/1991 | Townsend et al. | 439/608 |
| 5,078,626 | 1/1992 | Matsuoka et al. | 439/892 |
| 5,104,326 | 4/1992 | Smith et al. | 439/95 |
| 5,129,832 | 7/1992 | Marsh et al. | 439/79 |
| 5,133,670 | 7/1992 | Doi et al. | 439/79 |
| 5,133,679 | 7/1992 | Fusselman et al. | 439/608 |
| 5,192,215 | 3/1993 | Grabbe et al. | 439/73 |
| 5,194,017 | 3/1993 | Consoli | 439/492 |
| 5,348,488 | 9/1994 | Green et al. | 439/140 |

FOREIGN PATENT DOCUMENTS 1-279581 11/1989 Japan .

*Primary Examiner*—Gary F. Paumen
*Attorney, Agent, or Firm*—Anton P. Ness

[57] ABSTRACT

A pin spacer (28) for an electrical connector (1) includes, an insulating plate (29), alignment walls (31, 38) on the plate to engage and align pin portions (22) on electrical contacts (20) and tail portions (36) of surface amount terminals (3) projecting from a housing (2) of the electrical connector (1), post gripping guides (33) on the plate (28) secure the plate (28) on gripped keying posts (18) on the electrical connector (1), and serves to align the pin portions (22) and tail portions (36) relative to the posts (18).

17 Claims, 3 Drawing Sheets

PIN SPACER FOR AN ELECTRICAL CONNECTOR

FIELD OF THE INVENTION

The invention to be described relates to a pin spacer for an electrical connector, and more particularly, to a pin spacer that accurately aligns pin portions on electrical contacts for connection to a circuit board.

BACKGROUND OF THE INVENTION

According to a known electrical connector, keying posts on an underside of an insulating housing of the connector are adapted to register in apertures in a circuit board. The posts in the apertures accurately position the housing relative to the circuit board. Pin portions on electrical contacts project from the housing for connection to conductive areas arranged in a pattern on the circuit board. The conductive areas are on the surface of the circuit board for connection to surface mount contacts, and are also in apertures through the circuit board for connection to aperture mounted contacts.

According to U.S. Pat. Nos. 4,649,387 and 5,129,832, a pin spacer aligns pin portions of electrical contacts accurately with conductive areas arranged in a pattern on a circuit board. The pin spacer engages and aligns the pin portions where they project from a housing of an electrical connector. According to U.S. Pat. No. 4,842,528, a pin spacer can be constructed unitary with the housing of the connector. A unitary pin spacer assures accurate location of the pin spacer relative to the housing of the connector. However, a unitary pin spacer requires a complicated assembly operation, according to which, the electrical contacts are first inserted in the housing of the connector, and subsequently, the pin portions of the contacts are bent to move them into alignment against the pin spacer.

A pin spacer can be constructed as a separate part. This construction allows adjustment of the pin spacer to a desired position relative to the pin portions. However, the pin spacer, being a separate part, is subject to misalignment relative to the housing of the connector. Such misalignment of the pin spacer causes misalignment of the pin portions relative to a pattern of conductive areas on the circuit board.

SUMMARY OF THE INVENTION

An advantage of the invention resides in a pin spacer that will accurately align pin portions on electrical contacts with a pattern of conductive areas on a circuit board.

Another advantage of the invention resides in a pin spacer that will accurately align pin portions that are surface mount terminals.

Another advantage of the invention resides in a pin spacer that will accurately align pin portions that are either surface mount terminals or through hole mounted contacts.

Another advantage of the invention resides in a pin spacer that accurately aligns pin portions on electrical contacts relative to an electrical connector, and specifically, relative to keying posts on an electrical connector.

An embodiment of a pin spacer for an electrical connector is adapted for gripping keying posts of an electrical connector. The embodiment comprises self centering guides that first, capture keying posts on an electrical connector to align the pin spacer relative to the posts, and then, grip the posts to secure the pin spacer in place on the gripped posts. The embodiment engages pin portions on electrical contacts, aligning the pin portions relative to the posts.

An embodiment of a pin spacer for an electrical connector is adapted with pin alignment walls along apertures to align aperture mounted electrical contacts with apertures in a circuit board.

An embodiment of a pin spacer for an electrical connector is adapted with pin alignment walls along coplanar recesses to align surface mount electrical contacts for surface mount connection to a circuit board.

DESCRIPTION OF THE DRAWINGS

An embodiment of the invention will now be described with reference to the accompanying drawings, according to which.

DETAILED DESCRIPTION

Figure 1:
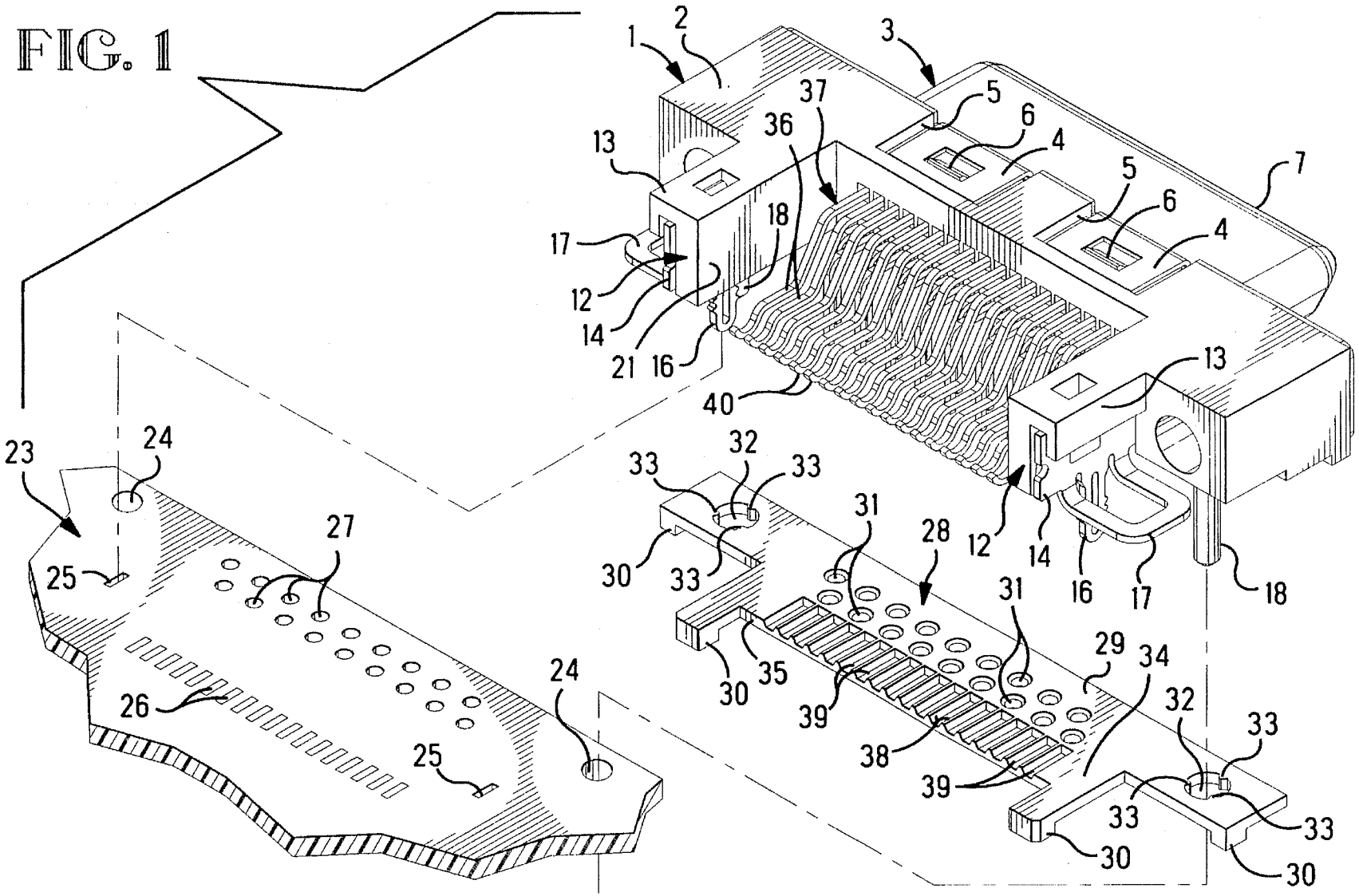
FIG. 1 is a perspective view of an electrical connector and a pin spacer.
Figure 2:
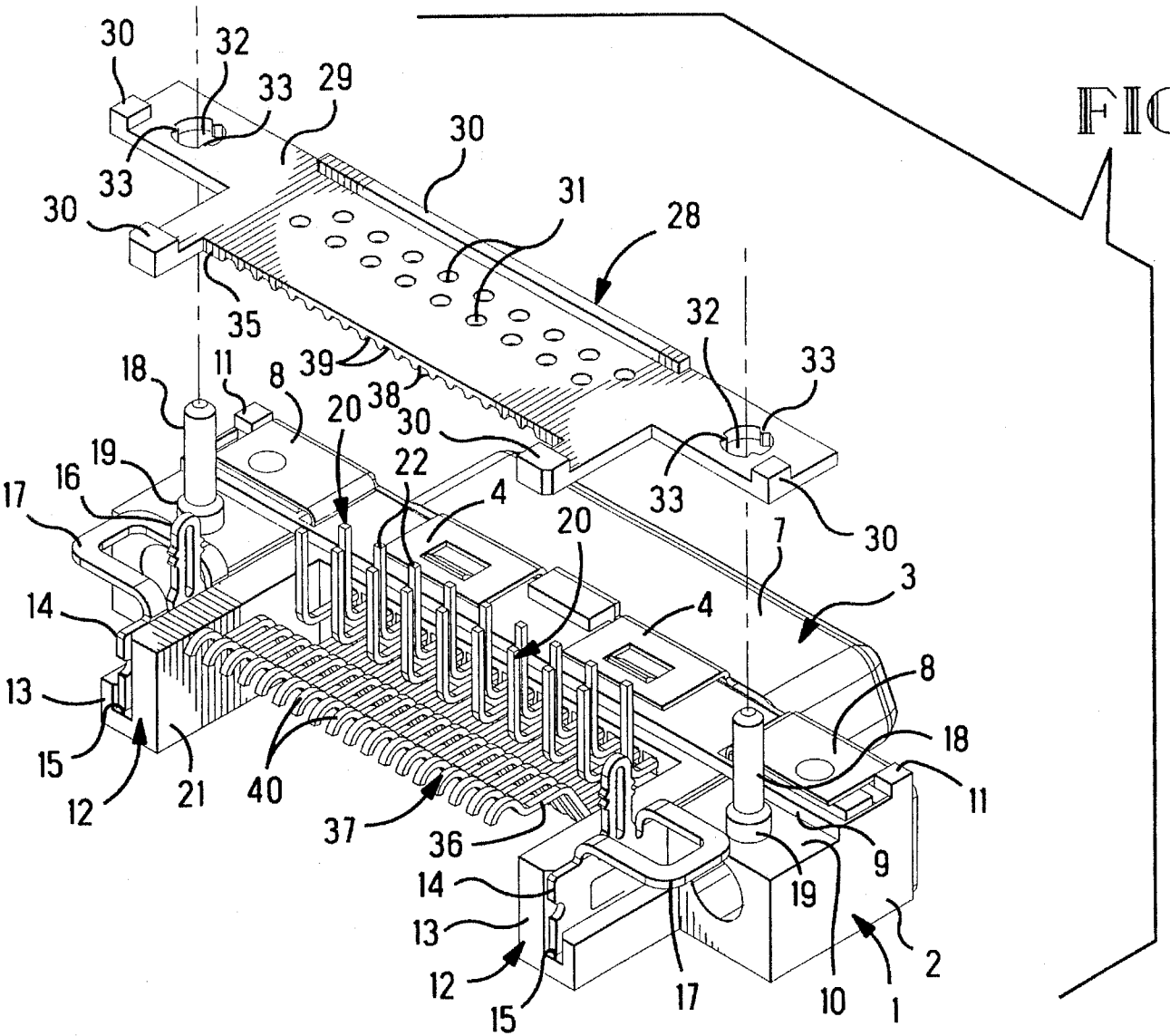
FIG. 2 is a perspective view of the connector and the pin spacer, as shown in FIG. 1, upside down, or inverted.
Figure 3:
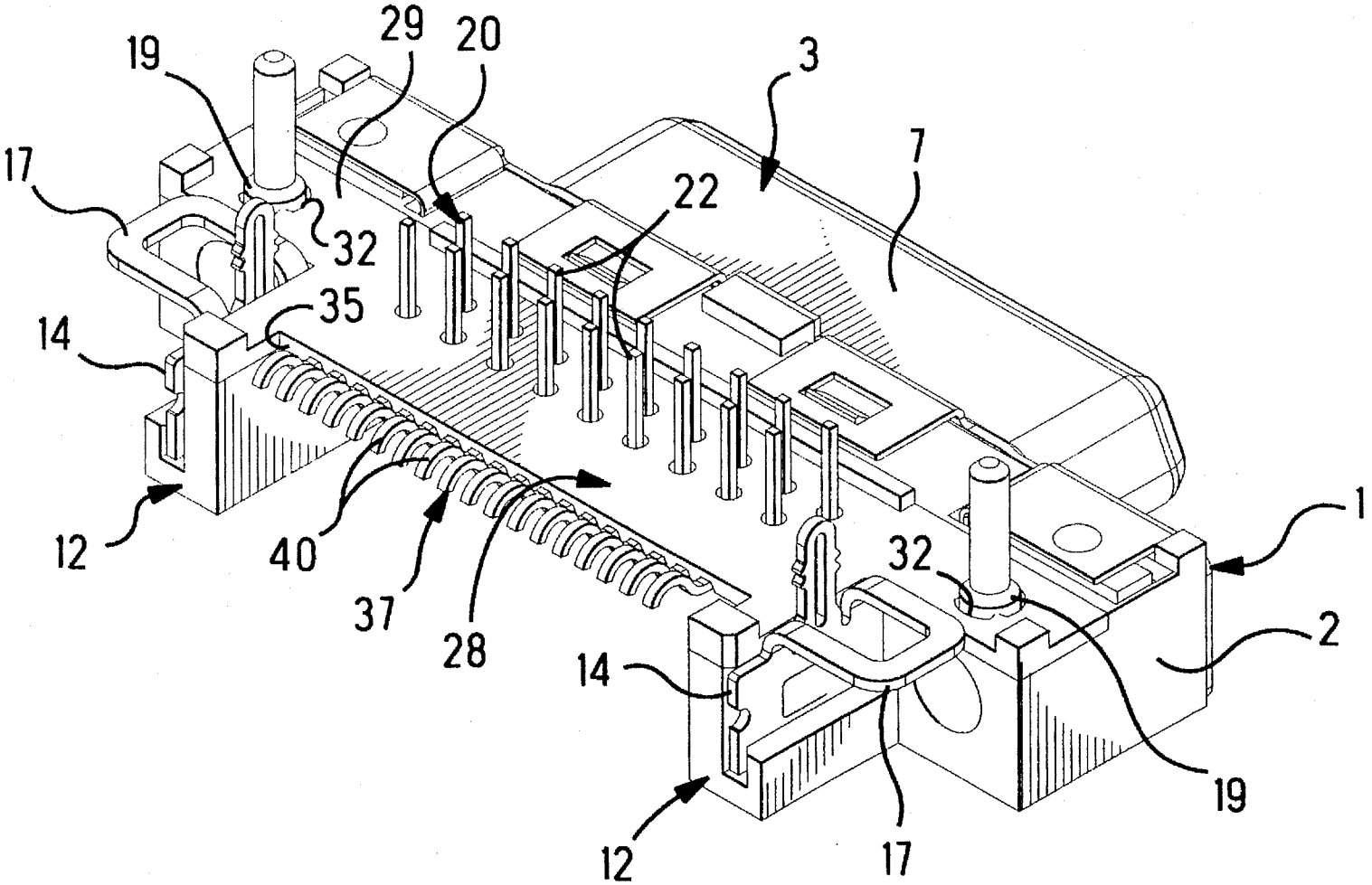
FIG. 3 is a view similar to FIG. 2, illustrating the pin spacer assembled to the connector and aligning pin portions of surface mount contacts and through hole contacts.

With reference to FIG. 1, an electrical connector 1 comprises, an insulating housing 2 of unitary construction. A metal, stamped and formed shield 3 is attached by hasps 4 that register in recesses 5 in the housing 2 and latch onto projections 6 on the housing 2. The shield 3 provides an encircling shroud 7 over a front of the housing 2. With reference to FIG. 2, the shield 3 has additional hasps 4 and extended grounding legs 8 that are bent to lie against a raised step 9 on an underside 10 of the housing 2. Projecting feet 11 extend from the step 9 to provide a bottom of the connector 2. With reference to FIGS. 1 and 2, a pair of spaced apart board locks 12 extend rearward and also below the housing 2. Each of the board locks 12 comprises, a rearward extending wall 13 on the housing 2, and a metal grounding element 14 mounted within a slot 15 in the wall 13. On each grounding element 14 is a through hole, grounding post 16 with barbs thereon extending outwardly beyond the bottom of the housing 2. A surface mount leg 17 on the board lock 12 extends laterally with respect to the bottom of the housing 2, and level with the bottom of the housing 2. The grounding element 14 is adapted for surface mounting, by severing and removing the grounding post 16, leaving the surface mount leg 17 on the grounding element 14. The surface mount legs 17 are adapted to be severed and removed, to leave the grounding posts 16 on the grounding element 14.

With reference to FIG. 2, keying posts 18 project from the bottom of the housing 2 to leading ends extending beyond leading ends of the contacts. Each of the keying posts 18 has a smaller circumference at the free end and along a substantial length, and a larger circumference 19 on an enlarged portion adjacent to the underside 10.

With reference to FIGS. 1 and 2, electrical contacts 20 extend through the housing 2 toward the front of the housing 2. The contacts 20 extend rearward and emerge in an opening 21 in the housing 2 between the board locks 12 on the housing 2. Board-connectable portions of the contacts 20 within the opening 21 are distributed in three rows. The board connectable portions in an outer, first row comprise tail portions 36 of surface mount terminals 37 having curved contact surfaces 40 along cantilever beams generally extending along the bottom of housing 2. The board-connectable portions along inner, second and third rows comprise elongated, through hole, pin portions or posts 22 extending at right angles to the bottom of the housing 2.

With reference to FIG. 1, a circuit board 23, a portion of which is shown, is adapted with spaced apart mounting apertures 24 to receive the keying posts 18 to orient as well as to mount the housing 2 with the bottom of the housing 2 against the circuit board 23. The keying post 18 provide mounting posts for the housing 2. The bottom of the connector 1 on the feet 11 register against the circuit board 23, while the feet 11 elevate the underside 10 of the housing 2 above the circuit board 23 to facilitate the passage of cleaning fluids. The circuit board 23 is adapted with plating lined apertures 25 to receive and electrically connect with the posts 16 of the board locks 12. The circuit board 23 is adapted with a pattern of conductive areas for connection to respective contacts 20 in the housing 2. The conductive areas comprise, a first row of surface mount pads 26 on the surface of the circuit board 23 adapted for connection by solder, not shown, to respective curved contact surfaces 40 on tail portions 36 of the surface mount terminals 37. Second and third rows of plating lined openings 27, or through hole apertures, through the thickness of the circuit board 23 are adapted for connection by solder, not shown, to respective through hole mounted posts on the two inner rows of pin portions 22. An objective of the invention is to align the board-connectable portions 22, 36 of the contacts 20, 37 for accurate placement on the pattern of conductive areas. Another objective of the invention is to align the board-mountable portions 22, 36 of the contacts 20 relative to the keying posts 18, whereby, dimensions for locating the board-mountable portions 22, 36 are referenced from the dimensions that locate the keying posts 18.

With reference to FIGS. 1 and 2, an insulative pin spacer 28 of unitary construction is generally in the form of a plate 29. The thickness of the pin spacer 28 is enlarged in various locations to provide projecting stand offs 30, or feet, adapted to register against the circuit board 23 and raise the pin spacer 28 away from the circuit board 23 to facilitate the passage of cleaning fluids.

The pin spacer 28 is adapted for aligning the through hole mounted pin portions 22 of respective electrical contacts 20. The pin spacer 28 is adapted with pin alignment walls 31 within individual openings through the pin spacer 28. The openings are arranged in a pattern that matches the pattern of the plating lined openings 27. The walls 31 receive respective, through hole mounted pin portions 22 in the openings. The walls 31 are arranged in a number of rows of openings, corresponding with the number of rows of through hole, mounted pin portions 22. For example, the through hole mounted pin portions 22 can be mounted in a single row, in which case, the walls 31 are arranged in at least one row of openings. In the embodiment, the walls 31 are arranged in two rows of openings corresponding to the two rows of through hole mounted pin portions 22. Accordingly, the pin spacer 28 is adapted with pin receiving openings to align the through hole mounted pin portions 22 with respective plating lined openings 27 through the circuit board 23.

The pin spacer 28 is assembled onto the keying posts 18 of the connector 1 to align the board-connectable portions 22, 36 with respect to the keying posts 18. Post receiving openings 32 through the thickness of the pin spacer 28 are aligned with and receive the keying posts 18. A set of post gripping guides 33, in the form of fingers, project radially inward from the circumference of each of the post receiving openings 32. The circumference of each post receiving opening 32, as well as a circumference circumscribed by the post gripping guides 33, both, are larger than the smaller circumference of a corresponding keying post 18, to allow significant lateral movement of the pin spacer 28 while received over the smaller circumference of each keying post 18. Such lateral movement enables the pin spacer 28 to deflect misaligned pin portions 22 into alignment without undo restriction of such movement by the keying posts 18.

The pin spacer 28 is displaced along the keying posts 18 until the gripping guides 33 grip the larger circumferences of the posts 18. During such displacement, the post gripping guides 33 center the axes of the post receiving openings 32 with the centerlines of the posts 18. The post gripping guides 33 center the openings 32 over the larger circumferences 19 of the posts 18 and wedge the posts 18 in the openings 32 to secure the plate 29 on the gripped keying posts 18. Accordingly, the openings 32 receive the posts 18 with a wedge fit. The plate 29 will register against the underside 10 of the housing 2 beneath the level of the step 9.

With reference to FIGS. 1 and 2, the pin spacer 28 is adapted to align the board-connectable portions comprising tail portions 36 of surface mount terminals 37. The pin spacer 28 is adapted with pin alignment walls 38 along the bottoms of pin receiving, grooved recesses 39 arranged in a pattern that matches the pattern of conductive pads 26 for surface mounting of the contact surfaces 23 on the surface mount terminals. The recesses 39 are in a top or connector proximate surface 34 of the plate 29 and extend to an opening 35 through the thickness of the plate 29. In the embodiment, the opening 35 is located at a rear edge of the plate 29. The recesses 39 are between said opening 35 at the edge of the plate 29 and the walls 38 in the pin receiving openings. When the pin spacer 28 is displaced along the keying posts 18, the pin alignment walls 38 in the grooved recesses 39 receive respective pin portions 22 comprising the surface mount terminals.

When the pin spacer 28 is displaced along each of the posts 18 toward the enlarged circumference 19 of each of the posts 18, the alignment walls 38 in the grooved recesses 39 resiliently bias the surface mount terminals upward to elevated, final positions. Thereby, the surface mount terminals 37 are aligned relative to the keying posts 18. The resiliently deflected tail portions 36 exert compression against the alignment walls 38, and thereby, are retained in fixed positions against the pin alignment walls 31 of the pin spacer 28.

The curved contact surfaces 40 of the solder mount terminals extend over, or overhang, the opening 35 at the rear edge of the plate 29 in alignment with the conductive pads 26. The contact surfaces 40 exert pressure against the pads 26 to facilitate joining to the pads 26 with solder. The thickness of the pin spacer 28 below the alignment walls and adjacent to the opening 35 is chosen and fabricated according to controlled manufacturing tolerances to control the elevation of the contact surfaces 40, and the position of the contact surfaces 40 relative to the bottom of the connector 1. In turn, the consequent pressure exerted by the contact surfaces 23 against the pads 26 is controlled. The thickness of the pin spacer 28 against the surface mount terminals is uniform to assure that the contact surfaces 40 are uniform in elevation to provide uniform pressure against the pads 26.

Other embodiments and modifications of the invention are intended to be covered by the spirit and scope of the claims.

I claim:

1. A pin spacer for an electrical connector having an insulative housing, a plurality of electrical contacts with pin portions extending therefrom and keying posts extending from the housing to leading ends beyond leading ends of the contact pin portions, comprising:

an insulating plate, alignment walls on the plate to engage and align board-connectable portions on electrical contacts projecting from a housing of an electrical connector, and post gripping guides on the plate to secure the plate on the keying posts and to align the board-connectable portions relative to the keying posts, wherein selected ones of the alignment walls extend along grooved recesses in a connector-proximate surface of the plate and to an edge thereof to align respective electrical contacts along the recesses, and with electrical contact surface of the respective contacts extending beyond the edge of the plate for connection to a circuit board.

2. A pin spacer as recited in claim 1 comprising:

projecting standoffs on an underside of the plate to elevate the plate relative to a circuit board.

3. A pin spacer as recited in claim 1 wherein, the post gripping guides comprise openings aligned with keying posts on the connector, and the openings being adapted to receive the posts with a wedge fit.

4. A pin spacer as recited in claim 1 wherein, the post gripping guides comprise openings receiving keying posts on the connector, and radially inward fingers in the openings to center the openings over respective said posts.

5. A pin spacer as recited in claim 1 wherein, the pin alignment walls extend along respective openings through the plate, and the walls align respective pin portions of electrical contacts extending through the openings.

6. A pin spacer as recited in claim 1 wherein, the alignment walls comprise: first alignment walls extending along openings through the plate, the first walls aligning first board-connectable portions of respective electrical contacts extending through the openings for connection to a circuit board, and second alignment walls extending along recesses in the plate, the recesses extending to an edge of the plate, and the second alignment walls align second board-connectable portions of respective electrical contacts along the recesses, with electrical contact surfaces of the second pin portions extending beyond an edge of the plate for connection to a circuit board.

7. A pin spacer as recited in claim 6 wherein, the openings are in at least one row, the openings are spaced from said edge of the plate, and the grooved recesses are between said edge of the plate and the openings in said row.

8. An electrical connector comprising:

an insulating housing, keying posts on the connector projecting below an underside of the housing, conductive electrical contacts in the housing, an insulating pin spacer mounted on the keying posts, first board-connectable portions on respective contacts projecting from the housing and extending along first alignment walls extending along openings through the plate, and second board-connectable portions of respective contacts along second alignment walls extending along recesses extending to an edge of the plate, and electrical contact surfaces on the second board-connectable portions extending beyond the edge of the plate for connection to a circuit board.

9. A pin spacer attachable to an electrical connector comprising:

a discrete insulating plate, alignment walls on the plate extending laterally along a connector-proximate surface of the plate to engage and align laterally extending tail portions of surface mount electrical contacts projecting from a housing of the electrical connector, an opening through a thickness of the plate adapted to receive contact surfaces on the ends of the tail portions projecting from an edge of the plate and into the opening, and a thickness of the plate at the edge of the opening below the alignment walls controlling the elevation of the contact surfaces relative to a bottom of the connector.

10. A pin spacer as recited in claim 9 comprising: projecting standoffs on an underside of the plate to elevate the plate relative to a circuit board.

11. A pin spacer as recited in claim 9 comprising second alignment walls in respective openings through the plate to engage and align pin portions of electrical contacts projecting from a housing of an electrical connector and through respective ones of the openings.

12. A pin spacer as recited in claim 9 wherein, the plate includes openings aligned with keying posts on the connector, and the openings are adapted to receive the keying posts with a wedge fit.

13. A pin space as recited in claim 9 wherein, the plate includes openings for receiving keying posts on the connector, and radially inward fingers in the openings, center the openings over respective ones of the keying posts.

14. A pin spacer as recited in claim 9 wherein, selected ones of the alignment walls extend along grooved recesses in the plate.

15. A pin spacer as recited in claim 14 comprising second alignment walls extending along respective openings through the plate to engage and align pin portions of electrical contacts projecting from a housing of an electrical connector and through respective ones of the openings, and the openings are spaced from said edge.

16. A pin spacer as recited in claim 15 wherein, the grooved recesses are between said edge of the plate and the opening.

17. An electrical connector comprising:

an insulating housing, keying posts on the connector projecting below an underside of the housing, conductive electrical contacts in the housing, an insulating pin spacer mounted on the keying posts, board-connectable portions on respective contacts projecting from the housing and extending along alignment walls extending along the plate to an edge of the plate, and electrical contact surfaces on the board-connectable portions extending beyond the edge for connection to a circuit board.

* * * * *